US011124940B1

(12) United States Patent
Manning et al.

(10) Patent No.: US 11,124,940 B1
(45) Date of Patent: Sep. 21, 2021

(54) BRACED SYNTHETIC MATTRESS SYSTEM FOR EROSION CONTROL

(71) Applicant: Propex Operating Company, LLC, Chattanooga, TN (US)

(72) Inventors: D. Scott Manning, Chattanooga, TN (US); Drew Loizeaux, Chattanooga, TN (US); Chastity Adkins, Chattanooga, TN (US)

(73) Assignee: PROPEX OPERATING COMPANY, LLC, Chattanooga, TN (US)

( * ) Notice: Subject to any disclaimer, the term of this patent is extended or adjusted under 35 U.S.C. 154(b) by 0 days.

(21) Appl. No.: 16/827,518

(22) Filed: Mar. 23, 2020

(51) Int. Cl.
*E02B 3/12* (2006.01)
*E02D 17/20* (2006.01)
*E02D 29/02* (2006.01)

(52) U.S. Cl.
CPC ..... *E02D 17/202* (2013.01); *E02B 3/122* (2013.01); *E02D 29/0291* (2013.01); *E02D 2600/20* (2013.01); *E02D 2600/40* (2013.01)

(58) Field of Classification Search
CPC ..... E02B 3/122; E02B 3/124; E02B 3/126; E02D 17/20; E02D 17/202
USPC ..... 405/19, 302.6, 302.7
See application file for complete search history.

(56) References Cited

U.S. PATENT DOCUMENTS 4,477,206 A * 10/1984 Papetti ..... F16L 1/123 405/172
4,726,708 A * 2/1988 Papetti ..... E02D 29/0208 405/19
5,039,250 A * 8/1991 Janz ..... E02D 17/202 405/15
5,368,410 A * 11/1994 Ferraiolo ..... E02D 17/20 405/15
5,567,087 A * 10/1996 Theisen ..... E02D 17/202 405/302.7
5,616,399 A * 4/1997 Theisen ..... E02D 17/202 139/408
6,296,422 B1 * 10/2001 Ferraiolo ..... E02D 29/0241 405/262
7,147,405 B2 * 12/2006 Ferraiolo ..... E02D 29/0241 405/284
9,493,923 B1 * 11/2016 Miller ..... E02D 29/02
2006/0263151 A1 * 11/2006 McMahon ..... E02B 5/08 405/302.6
2012/0020745 A1 * 1/2012 Miller ..... E02D 29/0208 405/284

(Continued)

FOREIGN PATENT DOCUMENTS

CN 106368238 * 2/2017 ..... E02D 17/20
JP 06228933 A * 8/1994

*Primary Examiner* — Frederick L Lagman
(74) *Attorney, Agent, or Firm* — Husch Blackwell LLP

(57) ABSTRACT

An internally braced synthetic mattress is a geosynthetic structure made of a geosynthetic material. The structure has a bottom side, a top side and at least one upright side joining at least a portion of the bottom side and top side. The at least one upright side is formed by an upright fold of the geosynthetic material. A horizontal bar is woven through a portion of the bottom side of the geosynthetic structure and joined with an upright bar and a diagonal bar to form at least one angle brace to support at least a portion of the geosynthetic structure. The geosynthetic structure contains a filler to prevent/reduce erosion.

15 Claims, 15 Drawing Sheets

(56) References Cited

U.S. PATENT DOCUMENTS

| | | | | |
|---|---|---|---|---|
| 2012/0223004 | A1* | 9/2012 | Ferraiolo | E02B 3/127<br>210/293 |
| 2019/0218736 | A1* | 7/2019 | Fiske | E02D 29/02 |

* cited by examiner

BRACED SYNTHETIC MATTRESS SYSTEM FOR EROSION CONTROL

FIELD OF THE DISCLOSURE

The present disclosure is directed to a braced synthetic mattress system for erosion control and a method of constructing an internally braced mattress to form a geosynthetic/soil/rock composite, allowing for vegetated or unvegetated, erosion-resistant flexible and permeable structures for erosion control.

BACKGROUND OF THE INVENTION

Rocks and rock-filled containers have been used to control erosion in areas requiring energy dissipation, constant flow of water, or generally high hydraulic stresses. Rocks of large diameter are typically required to resist hydraulic forces when not confined, while rocks of large to medium diameter are able to be used within a container. Using larger rocks helps minimize rock displacement but often encourages flow within the rock, resulting in erosion of the subgrade soil.

Existing rock-filled container systems generally use a wire mesh to form a collapsible framework which is then filled with rocks and/or other filler material and closed to form a final mattress structure. The collapsible framework should be held open and in position in order to adequately fill the framework. The individual mattresses are secured to one another using wire lacing or wire rings—a time consuming and tedious task.

It would be desirable to provide a self-supporting framework and method of constructing an internally braced mattress that can utilize small diameter rocks and/or other fill and promote vegetation establishment when desired. It would also be desirable to use nonmetallic components in the reinforcing system, thus eliminating concerns of corrosion and performance degradation especially in wet, marine, salty or other corrosive environments.

Therefore, in view of the foregoing, it would be advantageous to provide a system or structure that addresses one or more of the above deficiencies or other problems.

SUMMARY

The present disclosure provides an internally braced synthetic mattress. In an embodiment, the internally braced synthetic mattress comprises a geosynthetic structure made of a geosynthetic material, the structure having a bottom side, a top side and at least one upright side joining at least a portion of the bottom side and top side, the at least one upright side formed by an upright fold of the geosynthetic material; at least one angle brace comprising a horizontal bar woven through a portion of the bottom side of the geosynthetic structure, an upright bar, and a diagonal bar; and a filler contained within the geosynthetic structure, wherein a first end of the horizontal bar is connected with a first end of the upright bar, a first end of the diagonal bar is connected with a second end of the horizontal bar, and a second end of the diagonal bar is connected with a second end of the upright bar.

In another embodiment, the at least one upright side is supported by the at least one angle brace at the upright fold. In another embodiment, the upright bar is woven through the at least one upright side of the geosynthetic material.

In another embodiment, the internally braced synthetic mattress further includes at least one baffle composed of the geosynthetic material. In another embodiment, the at least one baffle is supported by the at least one angle brace. In another embodiment, the upright bar is woven through the geosynthetic material of the at least one baffle.

In another embodiment, the horizontal bar, upright bar, and diagonal bar are made of non-metallic material. In another embodiment, the horizontal bar, upright bar, and diagonal bar are made of nylon, polyethylene, polypropylene, polyesters, polyphenylene oxide, certain fluoropolymers, and mixtures thereof.

In another embodiment, the filler has an average diameter from 0.5 inches to 20 inches. In another embodiment, the geosynthetic structure has at least four upright walls, and at least two of the upright walls are formed by an upright fold of the geosynthetic material. In another embodiment, the at least one baffle extends between the at least two upright walls formed by an upright fold in the geosynthetic material.

In another embodiment, the geosynthetic material is a geosynthetic fabric designed to retain a material having an average diameter of less than 10 inches. In another embodiment, the geosynthetic material is a three-dimensional, cuspated profile, woven mat comprising a trilobal thermoplastic filament yarn.

The disclosure further provides a method of constructing an internally braced synthetic mattress. In an embodiment, the method comprises the steps of (a) laying out a first portion of geosynthetic material; (b) folding at least a portion of the first portion of geosynthetic material at a fold line to form a an upright side; (c) installing at least one angle brace, wherein the installing comprises weaving at least one horizontal bar into the first portion of the geosynthetic material, connecting a first end of an upright bar to a first end of the at least one horizontal bar, and connecting a diagonal bar to each of the horizontal bar and upright bar such that each end of the diagonal bar connects with a respective second end of the horizontal bar and the upright bar; (d) filling the geosynthetic material structure with a filler; and (e) securing a geosynthetic material over the filler and to the geosynthetic material structure to form the mattress.

In another embodiment, the at least one angle brace is installed adjacent to at least one edge of the geosynthetic material and the at least one horizontal bar is inserted into a weave of the geosynthetic material so that the first end of the horizontal bar aligns with the fold line of the geosynthetic material. In another embodiment, the step of installing the at least one angle brace includes weaving the upright bar into the geosynthetic material of the upright wall. In another embodiment, the method further includes the step of placing vegetation over the mattress. In another embodiment, the method further includes installing at least one baffle prior to filling the geosynthetic material structure with a filler. In another embodiment, the step of installing at least one baffle comprises providing a second portion of geosynthetic material having a fold line; installing, at uniform spacing along the geosynthetic material, a plurality of horizontal bars by inserting each horizontal bar into a weave of the geosynthetic material so that a first end of the horizontal bars aligns with a fold line of the geosynthetic material; installing, at locations adjacent the horizontal bars, a plurality of upright bars by inserting each upright bar into a weave of the geosynthetic material so that a first end of the upright bars is adjacent the first end of a respective horizontal bar to form horizontal bar/upright bar pairs; folding the geosynthetic material at the fold line; connecting the first ends of the respective horizontal bar/upright bar pairs; connecting a diagonal bar to each horizontal bar/upright bar pair such that each end of the diagonal bar connects with a second end of the horizontal and upright bars of a horizontal/upright bar pair to form the completed baffle; and securing the completed baffle to the first portion of geosynthetic material.

Figure 1:
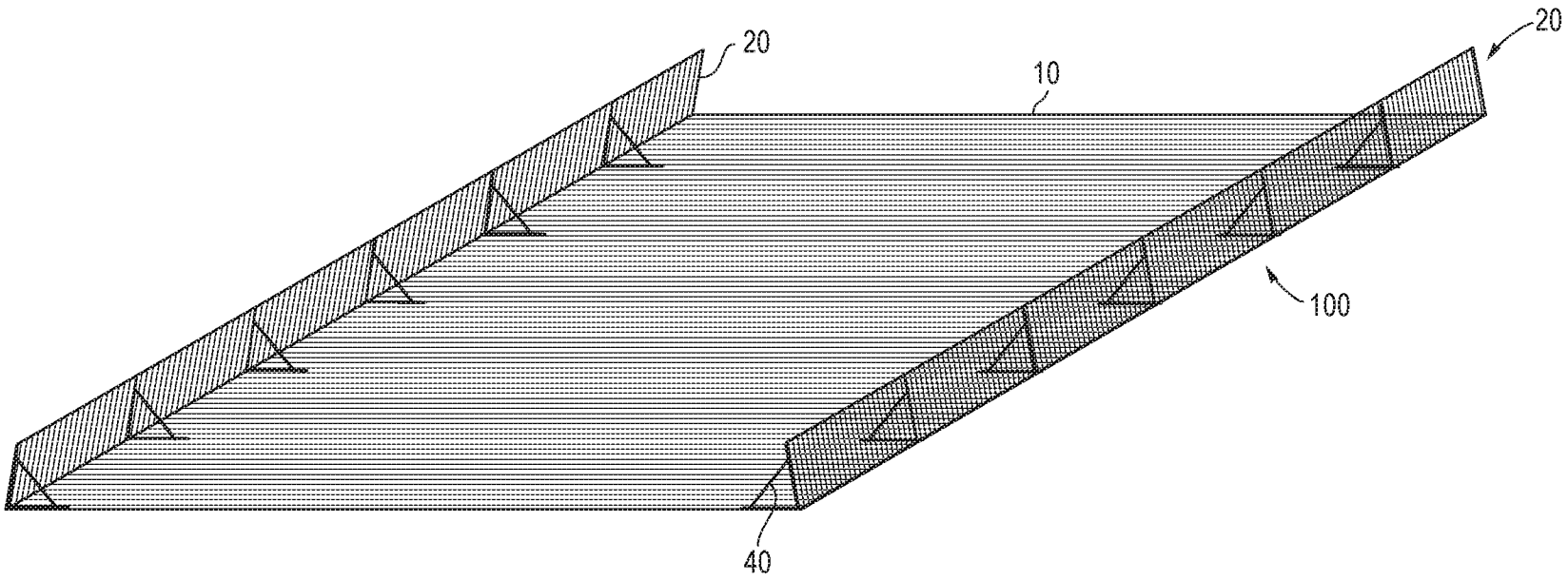
FIG. 1 is a perspective view of an exemplary braced synthetic mattress which is unfilled and with the top side removed, in accordance with embodiments of the present disclosure.

Although certain preferred embodiments of the present disclosure will be shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of an embodiment. The features and advantages of the present disclosure are illustrated in detail in the accompanying drawings, wherein like reference numerals refer to like elements throughout the drawings.

DETAILED DESCRIPTION

As a preface to the detailed description, it should be noted that, as used in this specification and the appended claims, the singular forms "a", "an" and "the" include plural referents, unless the context clearly dictates otherwise.

As used herein, the term "geosynthetic material" refers to any permeable material which can be used in an outdoor environment to separate, filter, reinforce, protect and/or drain. Geosynthetic materials are generally made of polypropylene and/or polyester. Geosynthetic materials include geotextile fabrics which can be woven, punctured, or heat bonded.

FIG. 1 illustrates an exemplary mattress 100 (unfilled and top side removed for clarity) according to embodiments of the present disclosure. The mattress 100 has a bottom side 10, at least one upright side 20 (or, more specifically in the embodiment shown, two sides 20), and a top side (not shown, 30). A series of internal angle braces 40 support the upright sides 20 and are each made of a plurality of bracing bars 50. The sides 10, 20, 30 are each made of a geosynthetic material.

In an embodiment, the geosynthetic material is a geotextile material, and more specifically a pyramidal-woven geotextile. An example of a pyramidal-woven geotextile which may be used with the present disclosure is described, for example, in U.S. Pat. Nos. 5,567,087 and 5,616,399 to Theisen, which are incorporated herein by reference. Such a geotextile includes two sets of filaments interwoven in substantially perpendicular directions to each other. The filaments or fibers are preferably woven into a type of pattern known as "waffle weave" or "honeycomb" type of woven pattern. This weaving procedure produces a generally planar fabric with a distinctive look of adjacent pyramids on one side of the fabric which oppose and are offset from adjacent pyramids on the other side of the fabric.

The filaments used to produce the geotextile are biaxially heat shrinkable. However, the amount of shrinkage is different for each filament depending on its position within the woven fabric. Hence, when the woven, initially planar fabric is subjected to heat, preferably from a hot steam or water bath, the filaments shrink proportionally to the different levels of heat shrinkage with which each filament was provided. Significantly, by arranging the filaments in a predetermined fashion based upon their level of heat shrinkage, the initially planar geotextile fabric becomes thicker and more three-dimensional in shape. After heat shrinking, the filaments provide a zig-zag cross-section and take up a substantially greater volume than when the fabric is relative planar. Consequently, a three-dimensional, high-profile woven geotextile fabric is formed.

To note, while the geotextile prior to heat shrinkage is referred to as generally planar, it will be appreciated that the geotextile must, by nature of its manufacture (i.e., woven in a waffle weave or honeycomb weave fashion), have an element of dimension. The heat treatment and resulting shrinkage serves to enhance the three-dimensional nature of the geotextile and make the pyramids starker in contrast to the non-heat treated geotextile.

The filaments utilized in the geotextile fabric are preferably thermoplastic monofilament yarns comprising materials such as polyethylene and polypropylene homopolymers, polyesters, polyphenylene oxide, certain fluoropolymers, and mixtures thereof. Most preferably the filaments are made of polypropylene, polyethylene, high tenacity polyester, or mixtures thereof.

Figure 2:
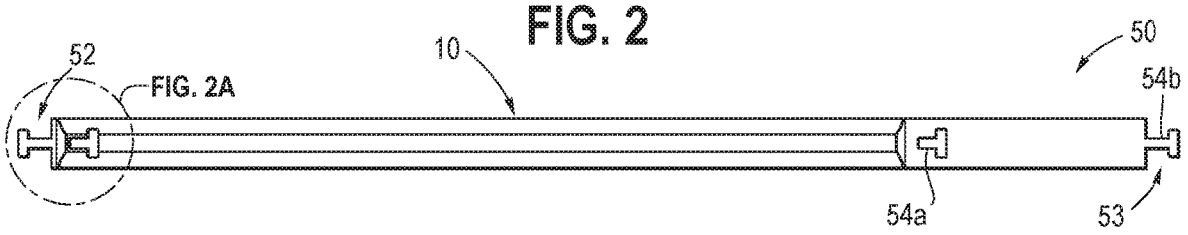
FIG. 2 illustrates an exemplary bracing bar for use with a mattress as disclosed herein, in accordance with embodiments of the present disclosure.
Figure 2A:
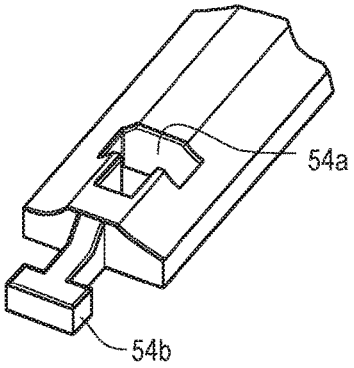
FIG. 2A is a close up perspective view of the portion 2A of FIG. 2.
Figure 3:
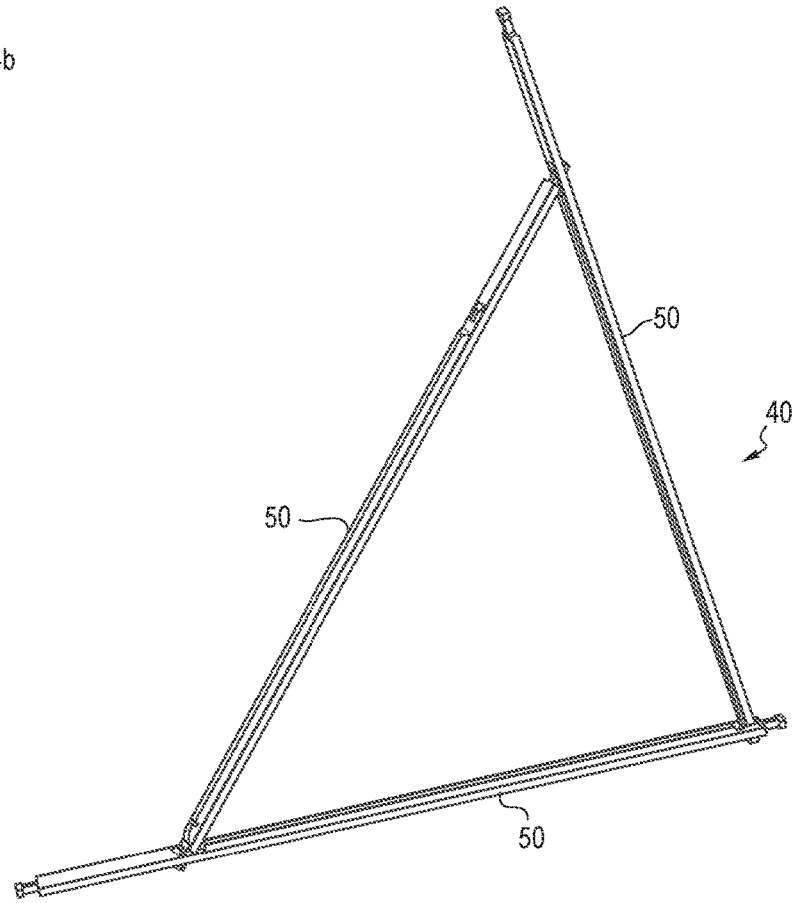
FIG. 3 is a side view of an exemplary angle brace formed using the bracing bar of FIG. 2, in accordance with embodiments of the present disclosure.

Referring to FIGS. 2, 2A and 3, each bracing bar 50 of the bracing assembly has a width and a length, both of which can be adapted as desired to meet particular needs. In the embodiment shown, for example, a bracing bar 50 has a width from 10 mm, or 12 mm, or 14 mm, or 16 mm to 18 mm, or 20 mm, or 25 mm. Further, in an exemplary embodiment, a bracing bar 50 has a length from 100 mm, or 150 mm, or 200 mm, or 250 mm, or 300 mm to 350 mm, or 400 mm, or 450 mm, or 500 mm, or 600 mm. In the particular embodiment illustrated, the bracing bar 50 is approximately 16-mm wide and 315-mm long.

In an embodiment, the bracing bars 50 have a cross-sectional shape which facilitates the weaving of a bracing bar 50 into the geosynthetic material. In the embodiment shown in FIG. 2, the cross-sectional shape of the bracing bar 50 is approximately trapezoidal; however, in further embodiments, the cross-sectional shape may be round, oval, triangular, tapered, or any combination of shapes which allows the bars 50 to be inserted/woven through the geosynthetic material. In particular, in the embodiment shown, the bars 50 have a specific width and trapezoidal cross-sectional shape allowing them to be easily inserted/woven through pyramidal projections of the geosynthetic material.

Each bracing bar 50 also has a connector structure 54*b* on each end 52, 53 along with an engagement structures 54*a* on each end 52, 53. The arrangement of the connector structures

54*b* and engagement structures 54*a* permits the bracing bars 50 to be connected to one another to form a brace 40. Depending on the needs of a particular job and desired shape of the braces 40 needed, the bracing bars 50 can be arranged in any fashion with the specific geometry and structure of the connector structures and engagement structures suitable for those needs.

In the embodiment shown in FIGS. 2, 2A and 3, the connector structures 54*b* are formations with contouring specific to physically engage the engagement structures 54*a* which are receiving apertures. More specifically, in the embodiment shown, the connector structures 54*b* are T-ends and the engagement structures 54*a* are slots.

It will be appreciated that the connector structures 54*b* and openings 54*a* are specifically arranged on their respective ends 52, 53 to permit three bars 50 to snap together to form a completed angle brace 40. For example, in the embodiments shown in which the brace 40 is an angle brace, each bracing bar 50 has two ends 52, 53, and each end 52, 53 has both an opening 54*a* and a connector structure 54*b*. According to this embodiment, a first end 52 has a opening 54*a* and a connector 54*b* nearly immediately adjacent one another, while at a second end 53 the opening 54*a* and connector 54*b* are separate by a distance. The openings may be specifically arranged such that a connector is secured within each opening by sliding the connector in the same direction for both opening (as in the embodiment shown in FIG. 2) or by sliding the connector in different directions.

As shown in FIG. 3, the openings and connectors of the bracing bars 50 are designed to engage one another such that two or more bracing bars 50 may be secured together. More specifically, and as shown in FIG. 3, three bracing bars 50 may be secured together to form an angle brace 40. To form an angle brace 40, a first bracing bar and a second bracing bar are positioned with their first ends 52 (or "B" ends as shown in FIG. 2) perpendicular to one another and the connector 54*b* from the first bracing bar engages the opening 54*a* of the second bracing bar. A third bar is then positioned diagonally between the first and second bracing bars. Because the remaining openings 54*a* with which the third bar will be engaged are inward form the ends of the first and second bar (that is, the openings 54*a* are on the second ends 53, or "A" ends as shown in FIG. 2), the third bracing bar can be the same length as the first and second bracing bar. The connectors 54*b* on both the first and second ends 52, 53 engage the openings 54*a* on the second ends 53 of the first and second bracing bars to form a complete angle brace 40.

The steps of forming a mattress 100 are now described in further detail.

First, a portion of a geosynthetic material is placed out. The geosynthetic material may be in accordance with any one or combination of embodiments described herein.

A first bracing bar 50*a* is woven through the geosynthetic material, and more specifically, through upraised pyramid shapes of the geotextile if applicable. The bracing bar 50*a*, which becomes a horizontal component, should be positioned such that the first end 52 (i.e., the "B" end) aligns with (so as to abut with) the fold line (or, the line along which the geosynthetic material will bend to form an upright side). In an embodiment, the bar engages from 1 thread, or 2 threads, or 5 threads, or 8 threads to 10 threads, or 12 threads, or 15 threads, or 20 threads, such as longitudinal threads, of the geosynthetic material. In an embodiment in which the geosynthetic material is a pyramidal-woven geotextile fabric, the first bracing bar 50*a* engages threads at the upraised fabric pyramids. For purposes of this description, the first bracing bar 50*a* will be referred to as a horizontal bar 50*a*, with the term "horizontal bar 50*a*" synonymous with "first bracing bar 50*a*."

Figure 4A:
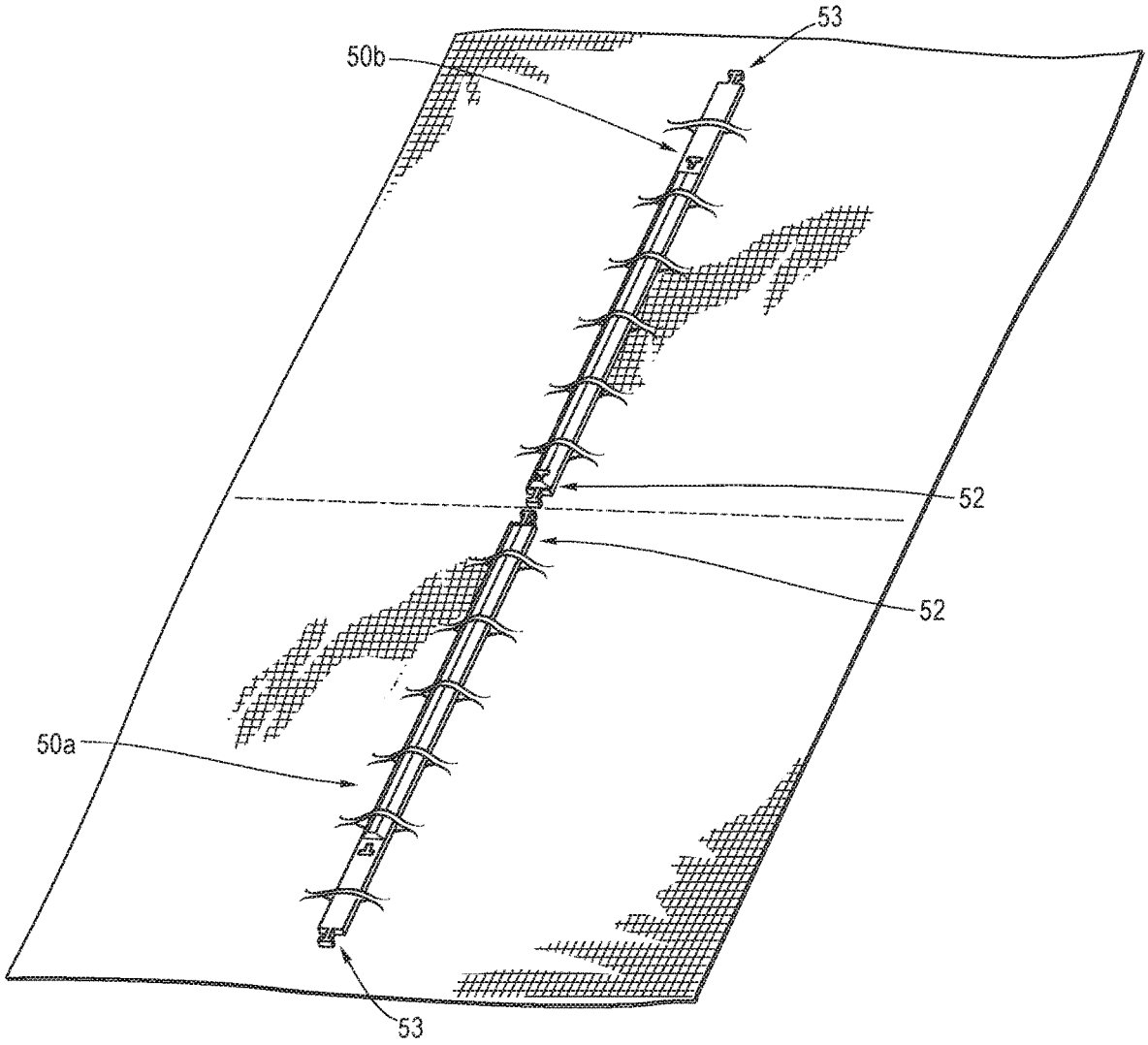
FIGS. 4A-4D illustrate the steps used to insert the bracing bars through the geosynthetic material and connect them to form an angle brace supporting a geosynthetic material, in accordance with embodiments of the present disclosure, with FIG. 4D being a close up view of the portion 4D of FIG. 4B.

A second bracing bar 50*b* is woven through the geosynthetic material, and more specifically in the embodiment shown, through upraised pyramid shapes of the geotextile fabric if applicable. The bracing bar 50*b*, which becomes a vertical component, should be positioned adjacent the first bracing bar 50*a* at a corresponding spot such that its first end 52 (i.e., the "B" end) abuts the first end 52 (or "B" end) of the horizontal bar 50*a* as shown in FIGS. 3 and 4A. In the embodiment shown in FIGS. 4A-4D, it will be appreciated that the openings 54*a* of the bracing bars are specifically located to align in-between the threaded pattern (that is, at gaps in the threaded pattern) of the geosynthetic material. For purposes of this description, the second bracing bar 50*b* will be referred to as a vertical or upright bar 50*b*, with the term "vertical bar 50*b*" or "upright bar 50*b*" synonymous with "second bracing bar 50*b*."

Figure 4B:
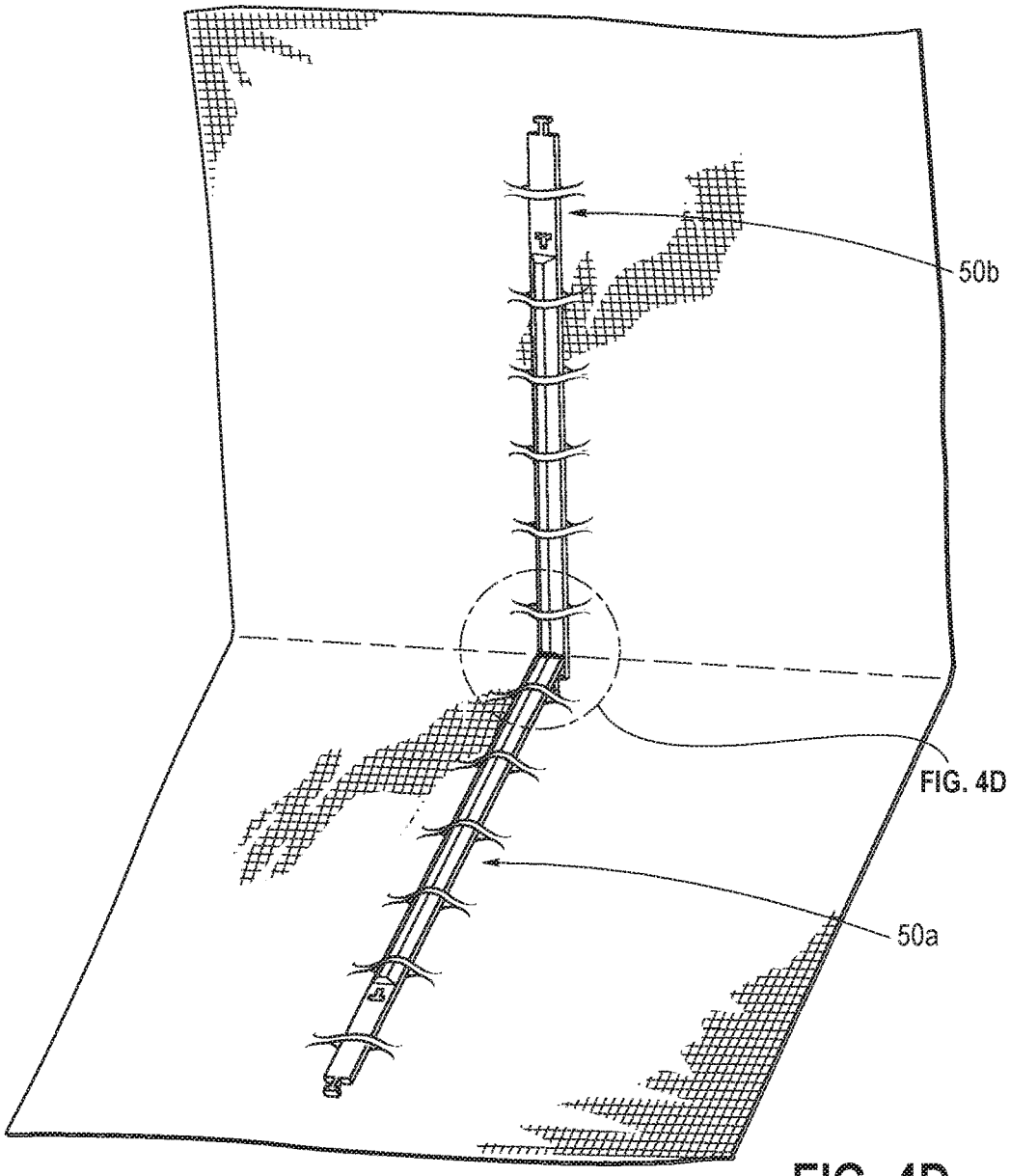
Figure 4D:
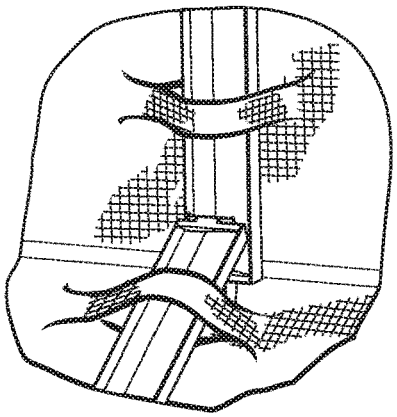

To form an upright side 20 of the mattress 100, the geosynthetic material is folded at the fold line, as shown in FIGS. 4B and 4D. To stabilize the upright side 20, the connector 54*b* of the upright bar 50*b* is inserted into the opening 54*a* of the horizontal bar 50*a* at the fold line. The resultant 2-component framework has a connector 54*b* from a first end 52 engaging a opening 54*a* from a first end 52.

Figure 4C:
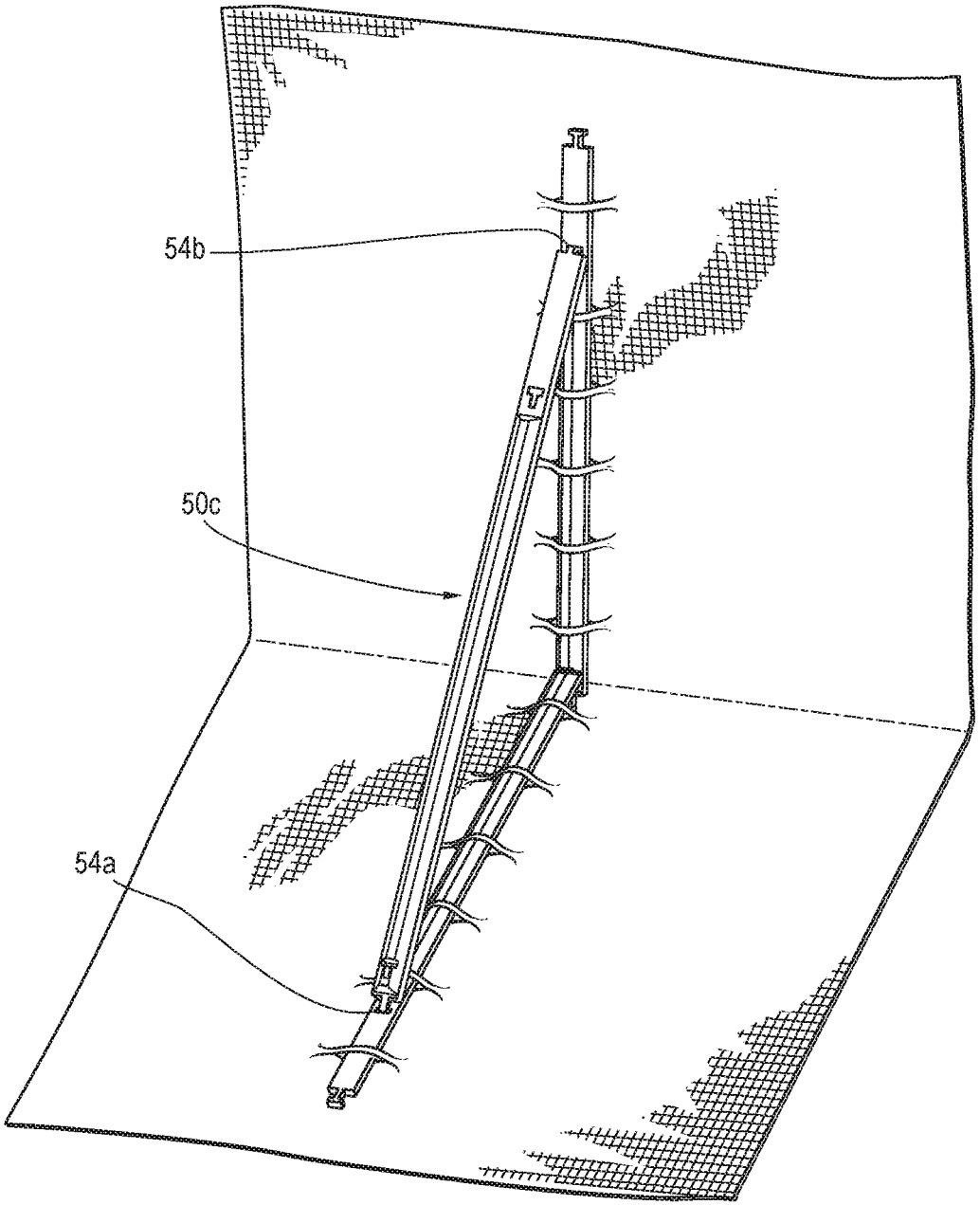

To install the diagonal bracing bar 50*c*, a first of its connectors 54*b* is inserted into the exposed opening of the horizontal bar 50*a* and a second of its connectors 54*b* is inserted into the exposed opening of the vertical bar 50*b*, such as shown in FIG. 4C. While in the embodiment shown, the diagonal bracing bar 50*c* is shown as having the connector 54*b* on its first side 52 (i.e., its "B" side) engaged with the horizontal bracing bar 50*a* and the connector 54*b* on its second side 53 (i.e., its "A" side) engaged with the vertical bracing bar 50*b*, it will be appreciated that the diagonal bracing bar 50*c* may be used in either direction. It will be further appreciated that the length of the upright bracing bar will determine the thickness of the mattress, and the length of the vertical bracing bar will determine the angle of the upright wall relative to the bottom of the mattress.

In the embodiments shown, the process of weaving horizontal and upright bracing bars into the geosynthetic material, folding the geosynthetic material, and supporting the fold with a diagonal bracing bar is repeated around the perimeter of the geosynthetic material to form an open-top, hollow tub structure. In an embodiment, the structure will be polygonal having at least two upright sides 20 supported with angle braces 40. More preferably, the structure will be polygonal having at least two uprights sides 20 supported with angle braces 40 and at least two further upright sides which may or may not be supported with angle braces 40.

The process of weaving horizontal and upright bracing bars 50*a*, 50*b* into the geosynthetic material, folding the geosynthetic material, and supporting the fold with a diagonal bracing bar 50*c* is repeated around the perimeter of the geosynthetic material to form an open-top, hollow tub structure. Generally, the structure will be rectangular.

The hollow structure is then filled (e.g., with rocks, pebbles, silt, dirt, sand, clay, geosythetics and/or other material) and a further piece of geosynthetic material is secured to the upper side of the structure to form the completed mattress 100.

When installed in an area requiring energy dissipation, constant flow of water, or generally high hydraulic stresses, soil and smaller debris which fills in between the rock fill permits passage of water while still encouraging plant growth on the mattress 100.

In an embodiment, the hollow structure is filled at least in part with a filler material having an average diameter from less than 0.5 inches, or 1 inch, or 2 inches, or 4 inches, or 6 inches, or 8 inches, or 10 inches to 12 inches, or 15 inches, or 18 inches, or 20 inches. In a particular embodiment, the hollow structure is filled with a filler material having an average diameter less than 10 inches, or less than 8 inches, or less than 6 inches, or less than 4 inches, or less than 2 inches, or less than 1 inch, or less than 0.75 inches, or less than 0.5 inches, or less than 0.3 inches. In an embodiment, the hollow structure is filled with a mixture of filler materials, with a majority of the filler material having an average diameter less than 10 inches, or less than 8 inches, or less than 6 inches, or less than 4 inches, or less than 2 inches, or less than 1 inch, or less than 0.75 inches, or less than 0.5 inches, or less than 0.3 inches, and the remainder having an average diameter from 10 inches to 12 inches, or 15 inches, or 18 inches, or 20 inches.

In an embodiment, the filler material comprises rocks, pebbles, silt, dirt, sand, clay, geosythetics and combinations of these and other materials. In a particular embodiment, the filler material comprises rocks.

In an embodiment, the filler material comprises a majority (greater than 50%) rocks having an average diameter from less than 0.5 inches, or 1 inch, or 2 inches, or 4 inches, or 6 inches, or 8 inches, or 10 inches to 12 inches, or 15 inches, or 18 inches, or 20 inches. In a particular embodiment, the filler material comprises rocks having an average diameter less than 10 inches, or less than 8 inches, or less than 6 inches, or less than 4 inches, or less than 2 inches, or less than 1 inch, or less than 0.75 inches, or less than 0.5 inches, or less than 0.3 inches. In an embodiment, the filler material comprises a mixture of materials, with a majority of the filler material being rocks having an average diameter less than 10 inches, or less than 8 inches, or less than 6 inches, or less than 4 inches, or less than 2 inches, or less than 1 inch, or less than 0.75 inches, or less than 0.5 inches, or less than 0.3 inches, and the remainder of the filler material being a material having an average diameter from 10 inches to 12 inches, or 15 inches, or 18 inches, or 20 inches.

The ability to utilize small fill (i.e., rocks with an average diameter less than 10 inches, or less than 8 inches, or less than 6 inches, or less than 4 inches, or less than 2 inches, or less than 1 inch, or less than 0.75 inches, or less than 0.5 inches, or less than 0.3 inches) improves erosion control capability. With any rock mattress system, when water flows across the system, a portion of the water flows within the rock void space. This water that flows within the rock void space can then interact with the soil interface below and cause erosion. Rock mattress systems which utilize twisted or welded wire mesh containers with openings having an average diameter of greater than 10 inches require the use of filler (e.g., large rocks having an average diameter of greater than 10 inches), which results in minimal resistance to erosion because of the great void space. In using small fill, the void space is reduced and, as a result, there is better erosion control.

Figure 7A:
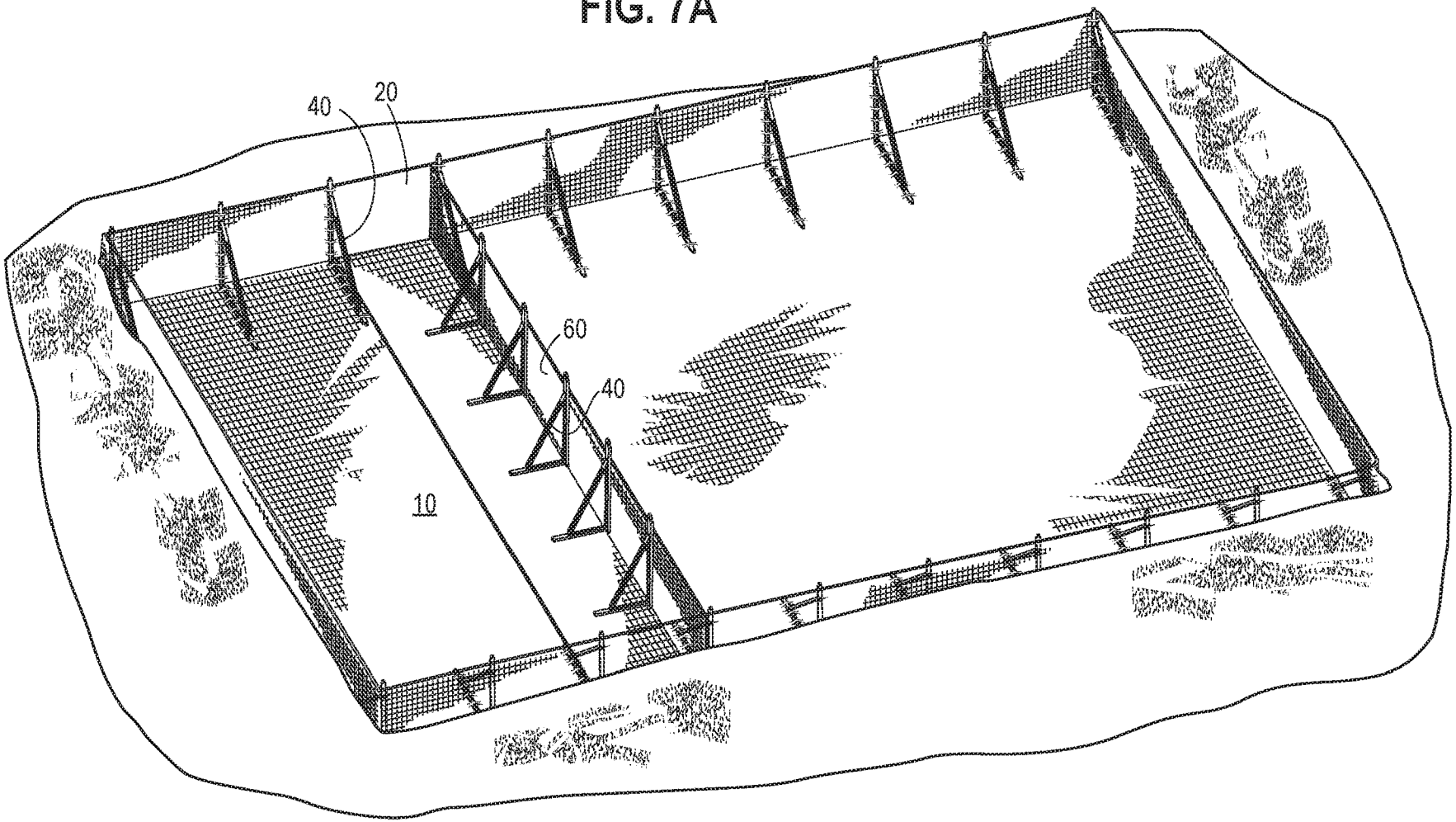
Figure 7B:
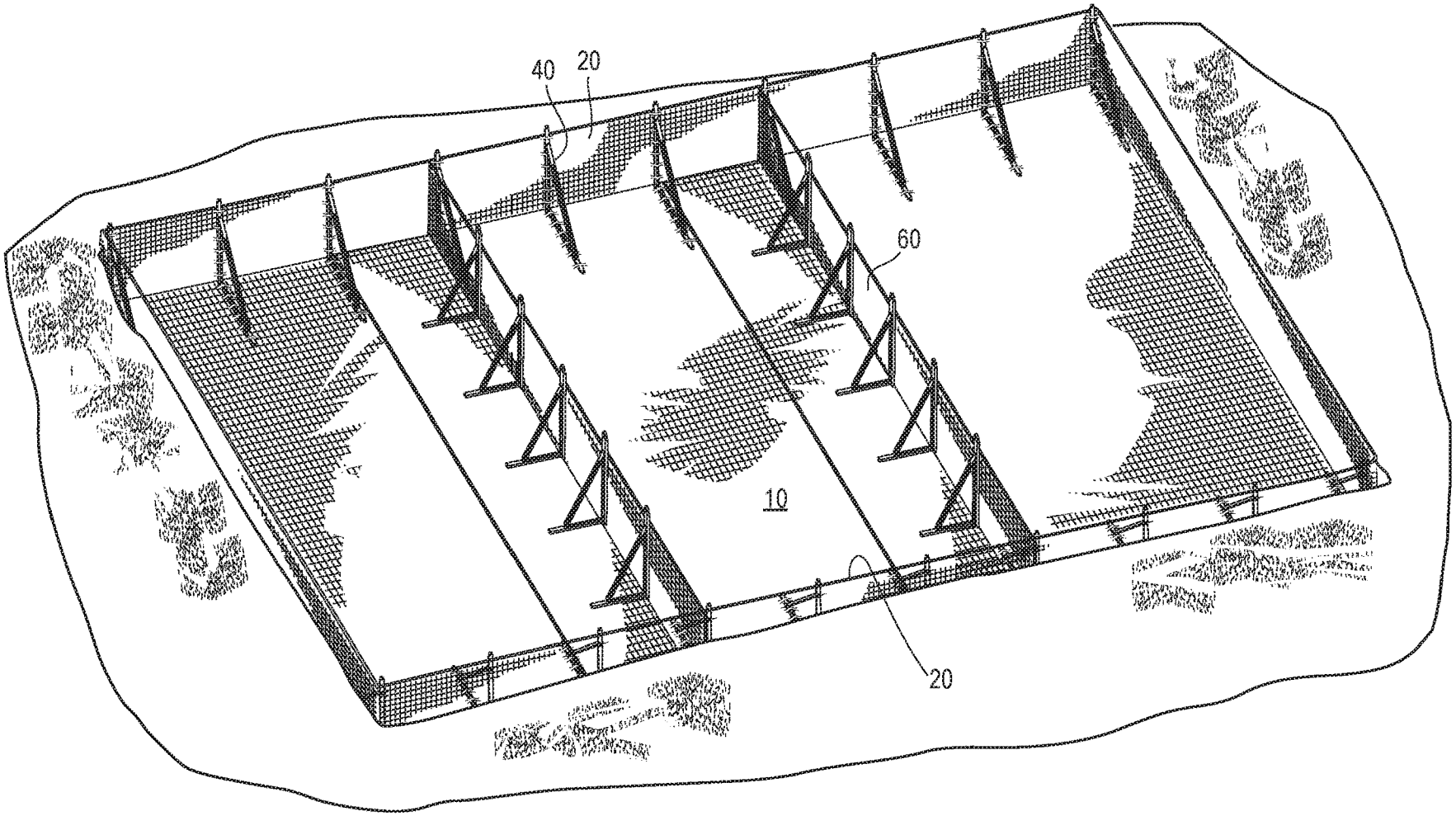

Depending on the size and shape of the mattress 100, it may be desirable to use additional bracing bars and geosynthetic material to create baffles 60 within the mattress, such as shown with reference to FIGS. 7*a* and 7*b*. To form baffles, a plurality of angle braces 40 are made along the length of a further piece of geosynthetic material. The horizontal portion of the geosynthetic material is secured to so as to overlap the bottom side 10 of the mattress 100 at the desired location. The angle braces 40 hold the upright wall portion of the baffle 60 upright. It will be evident that any baffles 60 will need to be formed and secured in position prior to filling the mattress.

In an embodiment, one or more baffles 60 may be used to form one or more uprights sides of a mattress 100.

The process of constructing a braced synthetic mattress system for erosion control is now described with reference to FIGS. 5-10.

First the subgrade is prepared to the desired compaction, elevation and gradient. If additional over-excavation is needed to remove soft soil or deleterious material, then it should be replaced by a compacted fill material suitable for the application. A portion of geosynthetic material is placed along the subgrade. Optionally, an additional geosynthetic material separator may be placed between the subgrade and the geosynthetic material of the mattress.

Figure 5:
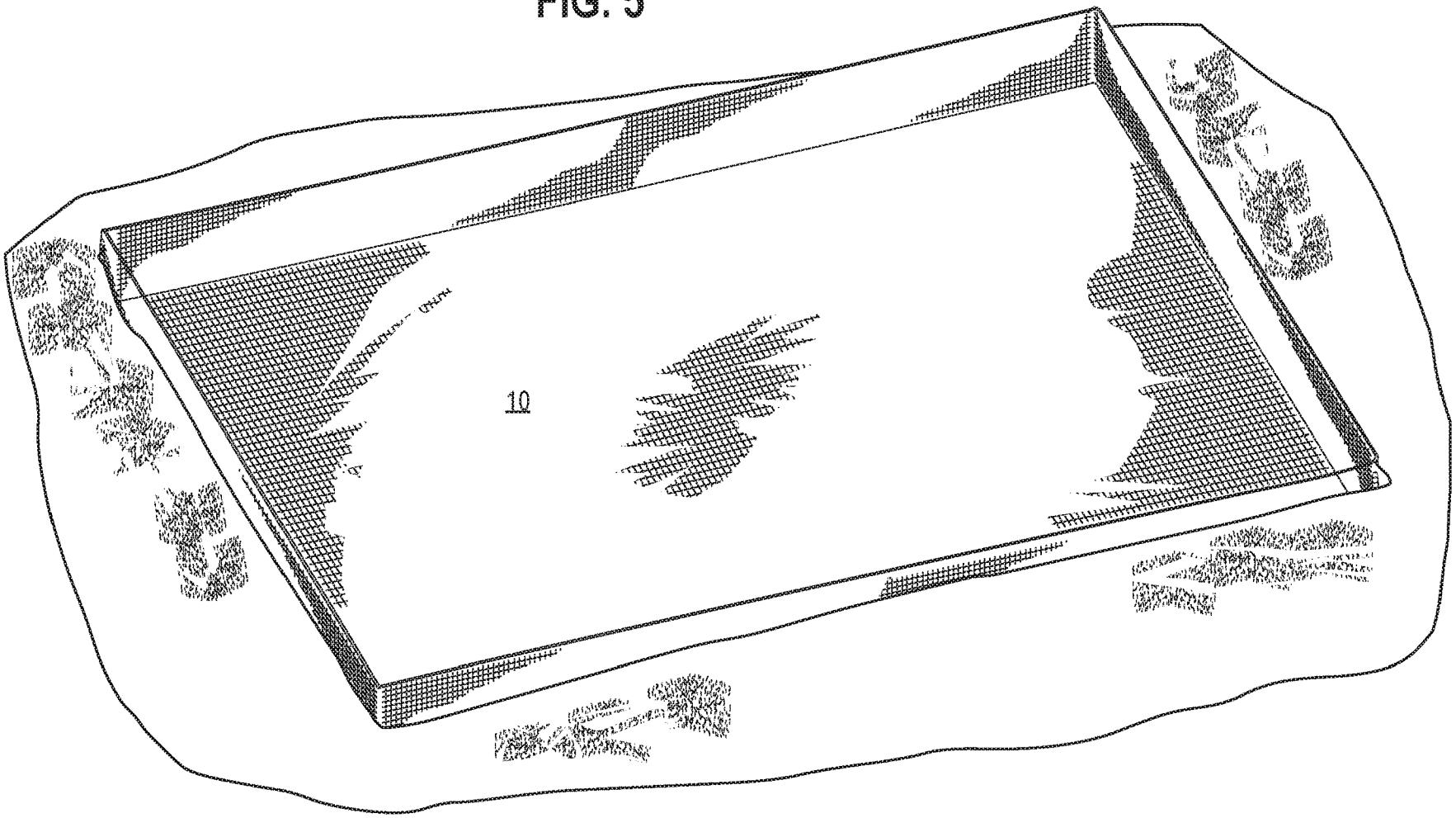
FIGS. 5-10 illustrate a process for constructing a braced synthetic mattress system, in accordance with embodiments of the present disclosure.
Figure 6:
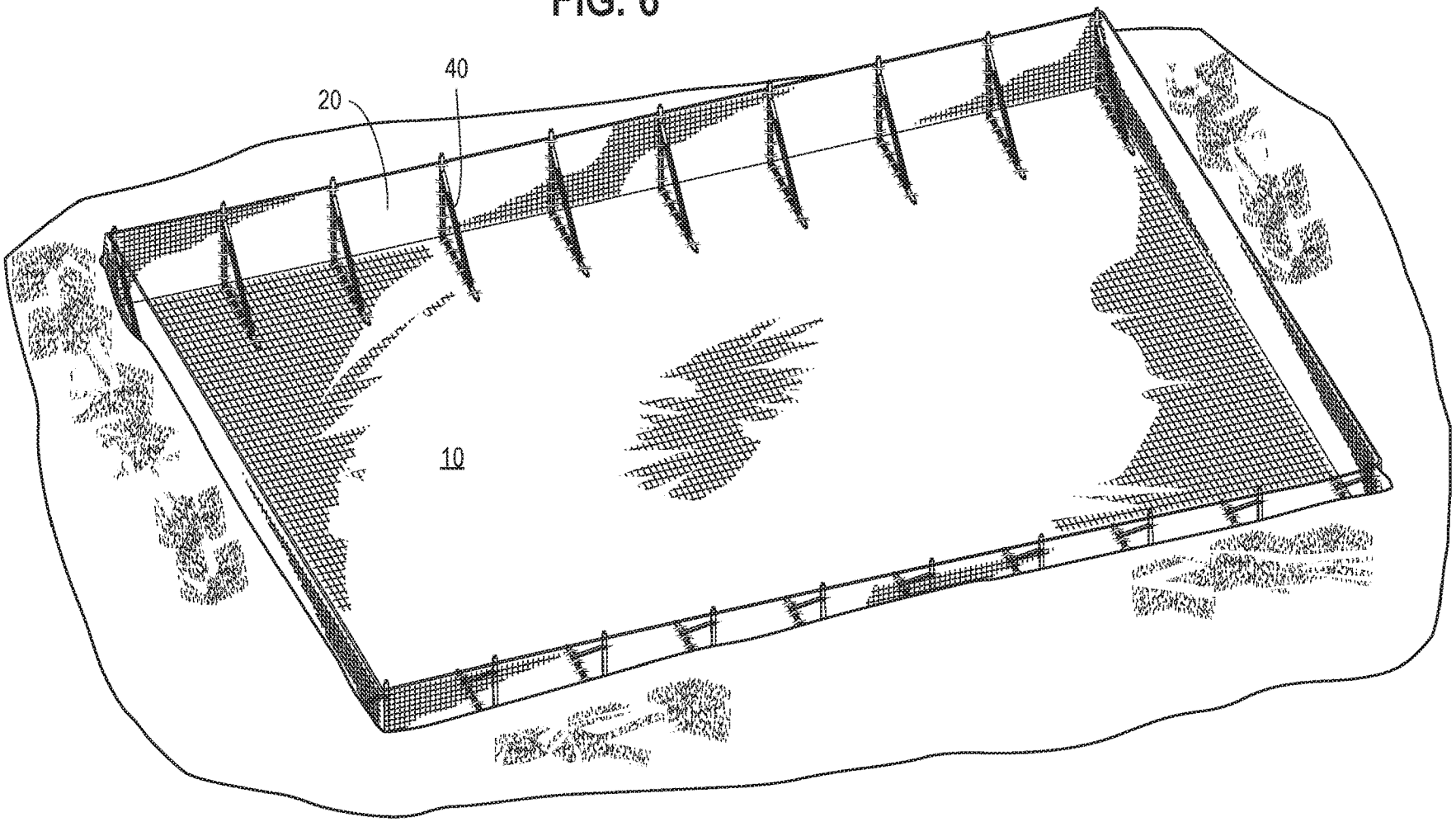

Internal bracing is inserted into the geosynthetic material as described herein at predetermined locations to form the desired mattress shape. FIG. 5 shows the geosynthetic material with a plurality of bracing bars 50 (i.e., horizontal bars 50*a* and upright bars 50*b*) positioned along the length of the geosynthetic material. The geosynthetic material is folded and the bracing bars 50*a*, 50*b* are connected to form the upright walls 20 of the mattress 100, as shown in FIG. 6 and described in detail above.

A predetermined number of baffles 60 (if necessary) are assembled as described herein and secured to the bottom of the structure, as shown in FIGS. 7*a* and 7*b*.

Figure 8A:
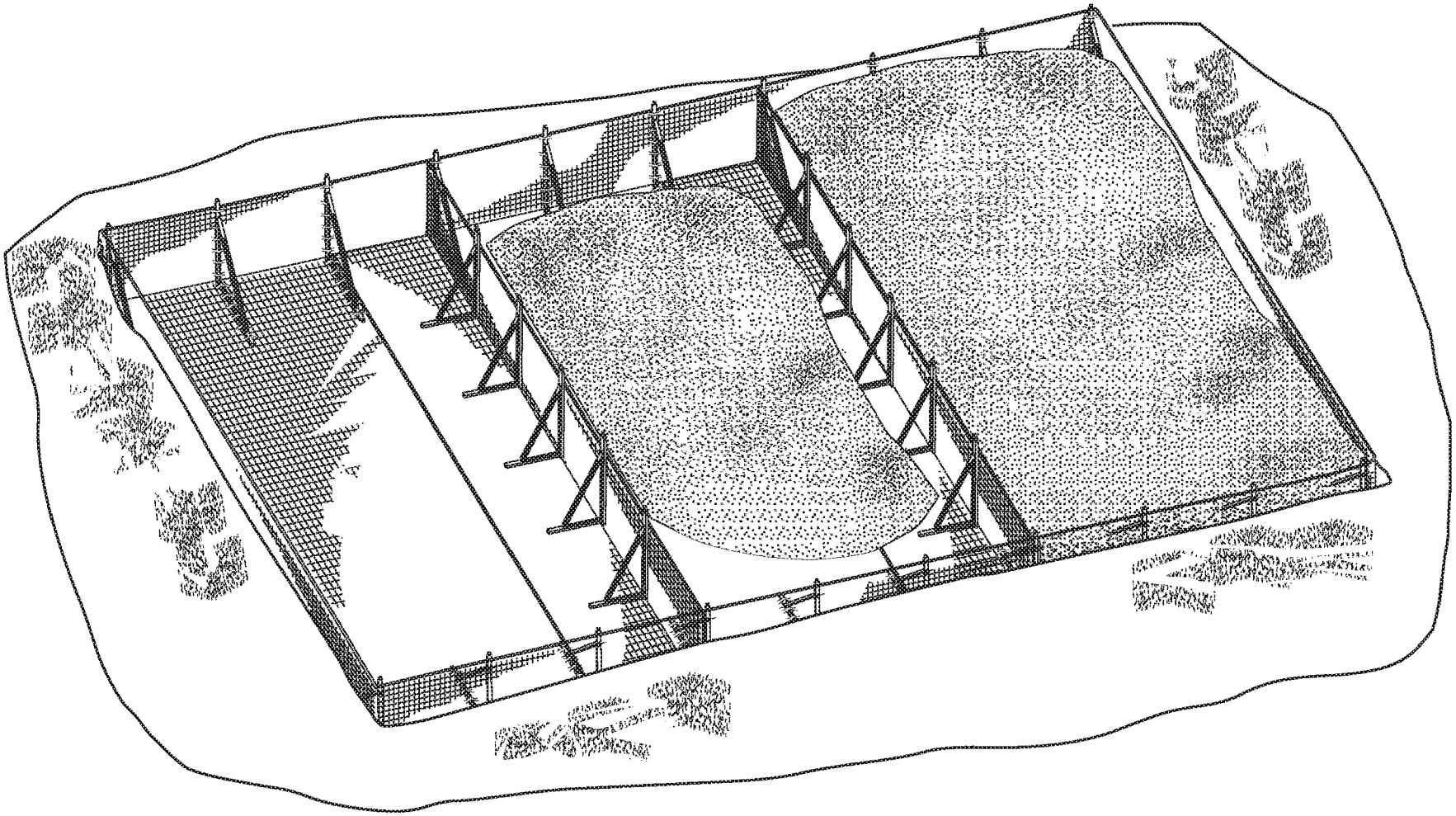
Figure 8B:
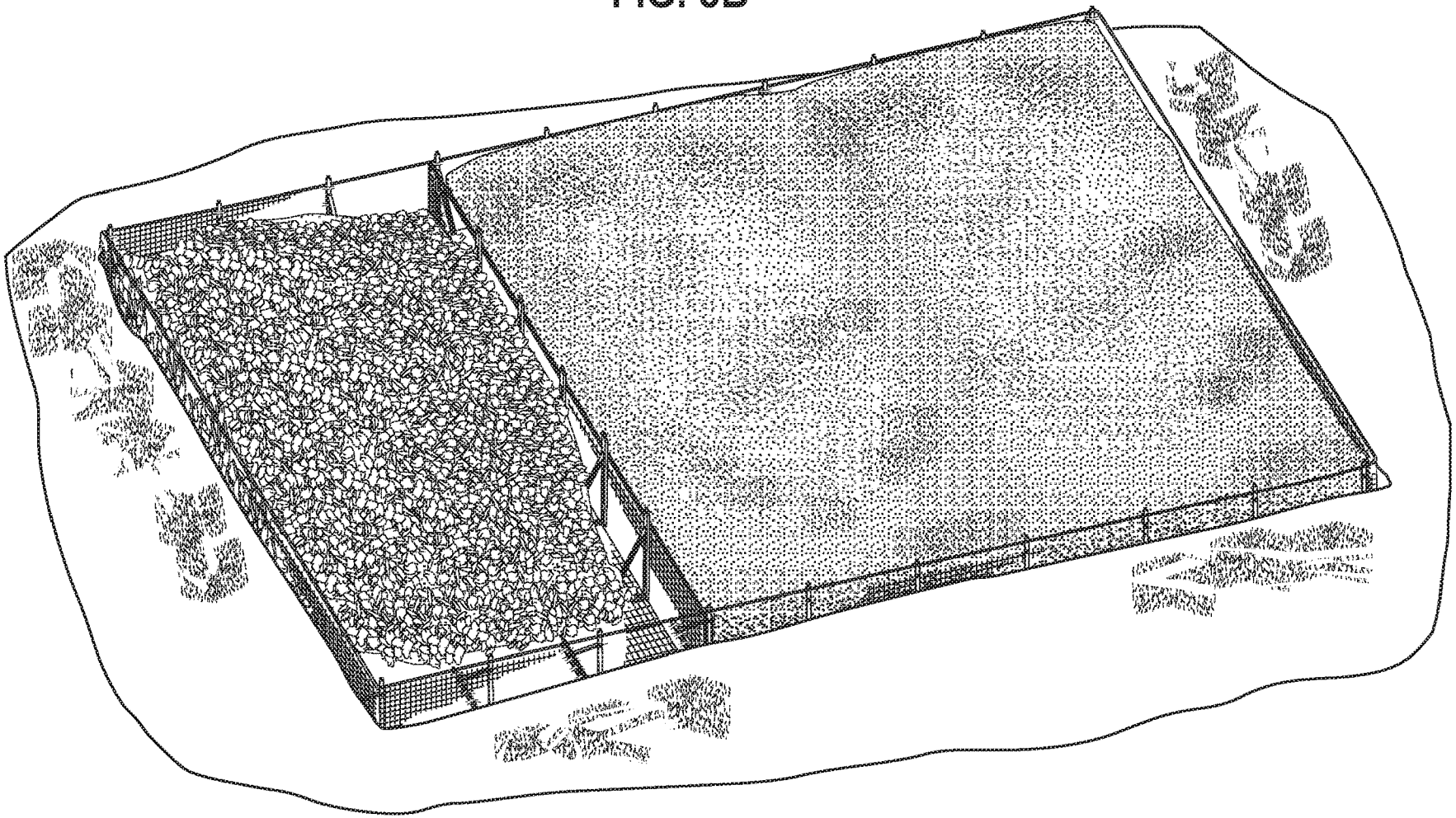

The mattress 100 is then filled, as shown in FIGS. 8*a* and 8*b*. If multiple mattresses (or partial mattresses) are used, it is important to fill adjacent mattresses (or adjacent mattress units, such as shown in FIGS. 8*a* and 8*b*) in increments and not entirely fill one mattress before moving to the others.

Figure 9A:
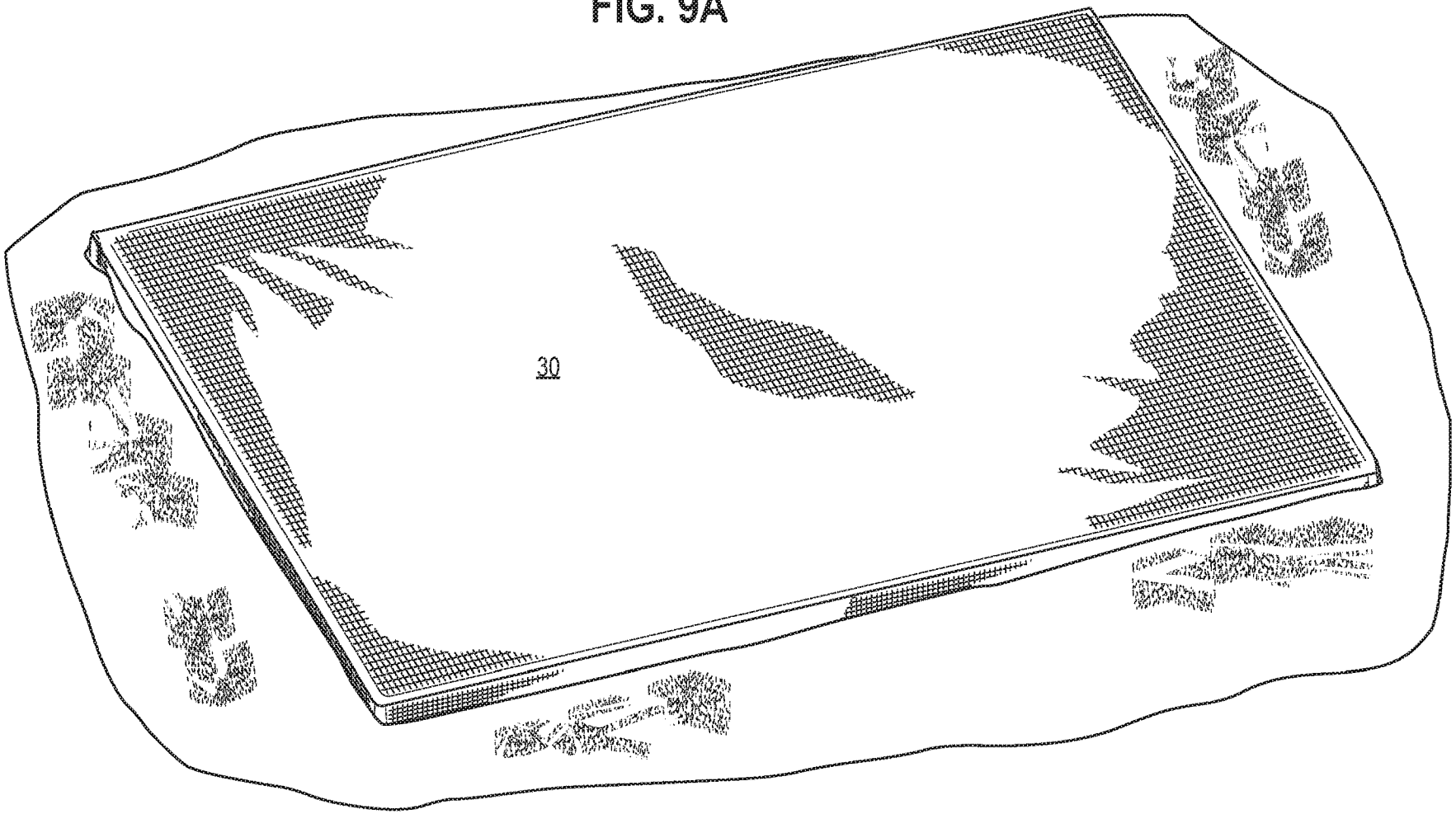
Figure 9B:
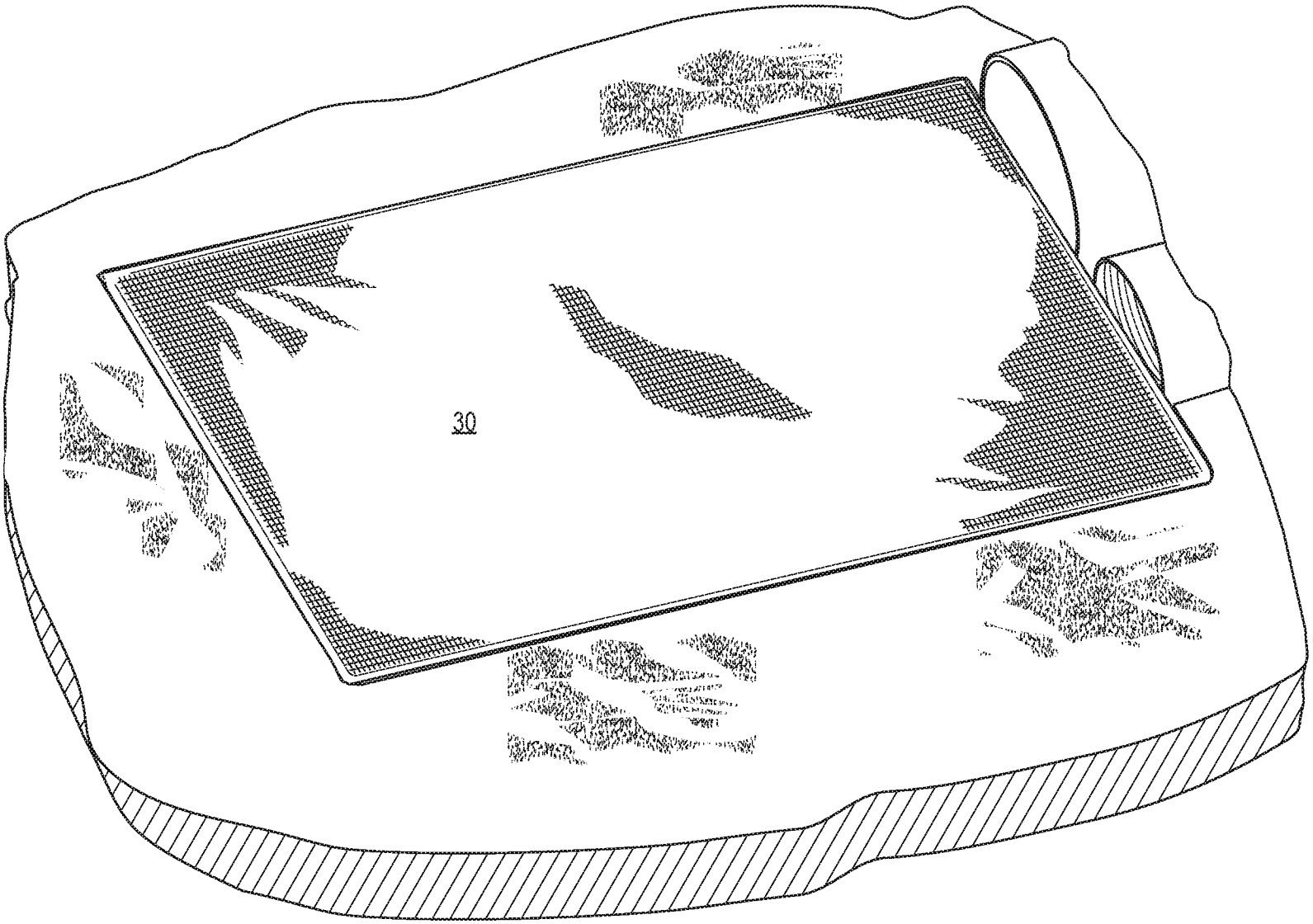

Once the mattress 100 is filled, a further portion of geosynthetic material having a shape approximately corresponding to that of the bottom side 10 (not visible) is placed over the fill and secured to the at least one side (and, if present, baffles), as shown in FIGS. 9*a* and 9*b*. In some embodiments, an optional geosynthetic material separator may be provided between the fill and the geosynthetic material. Once the mattress is fully formed, the land around the mattress may be landscaped to come flush with the mattress, as shown in FIG. 9*b*, although it is not necessary.

Figure 10:
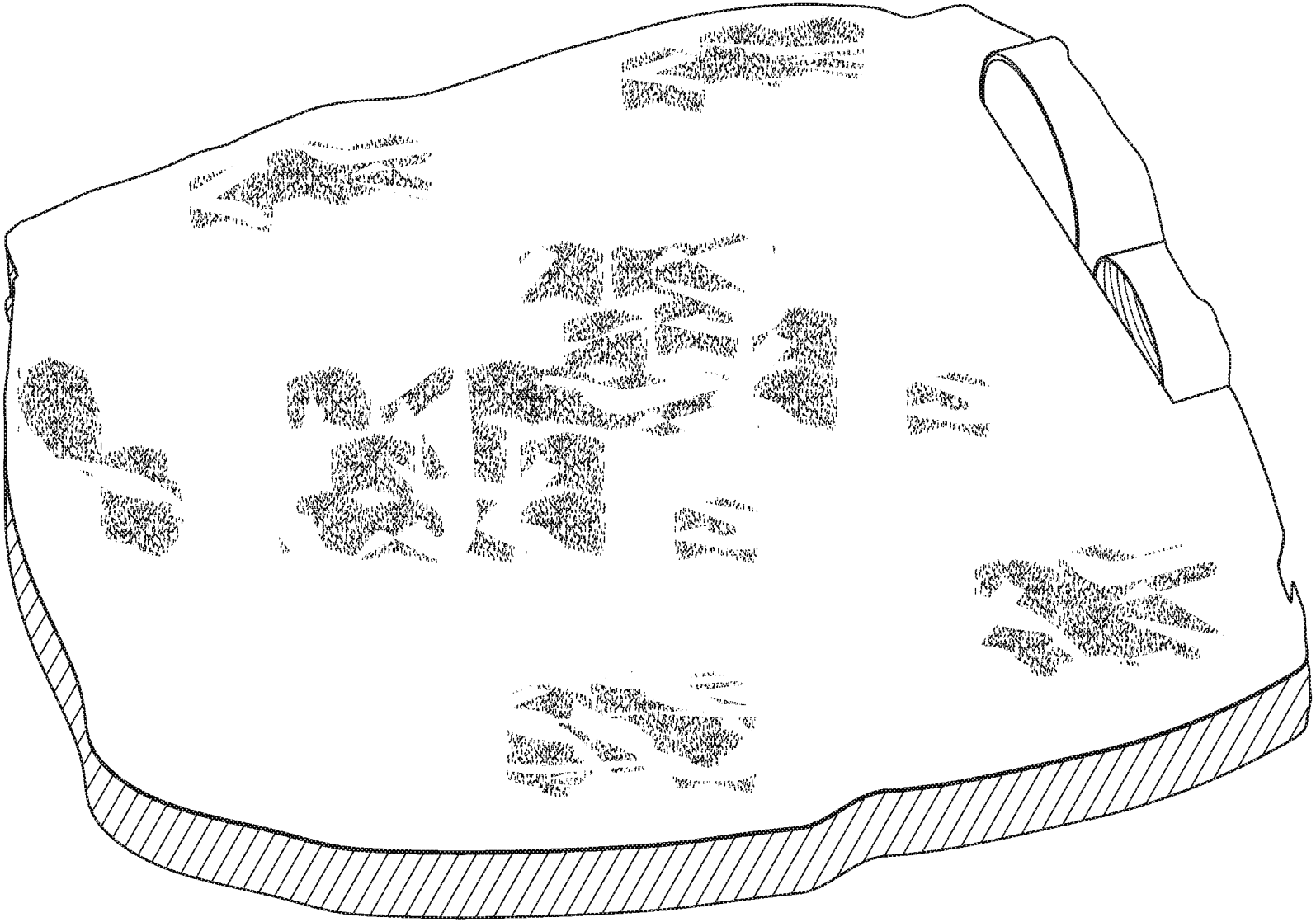

Finally, and optionally, vegetation may be established on the top side 40 of the mattress 100, as represented in FIG. 10.

It will be appreciated that the mattress 100 can take any number of shapes provided on the layout and configuration of the bracing bars. In the embodiment shown in FIGS. 5-10, for example, the mattress 100 is rectangular having four corners at approximately right angles, with two upright sides 20 formed from the geosynthetic material forming the bottom side 10 and two upright sides 20 formed from the geosynthetic material making the top side 30. However, in further embodiments, the mattress may be circular, elliptical, square, triangular, or any polygonal shape as needed. Further, in some embodiments, one or more sides of a mattress may be formed from a baffle structure. In an embodiment, the mattress is therefore considered as having at least one side (i.e., at least one vertical or upright surface), though preferably the mattress will have at least three sides, or at least four sides. That is, in an embodiment, the mattress is a structure having a bottom, a top, and at least one side, preferably at least three sides, and more preferably at least four sides.

Moreover, in the embodiments shown and described herein, the mattresses have angle braces 40 both around the perimeter of the mattress and to support baffles 60. However, in some embodiments, it is not necessary and/or desirable to have angle braces 40 supporting at least a portion of the perimeter (or, in some embodiments, the entire perimeter). For example, the surrounding landscape and/or filling may be sufficient to support the perimeter of a mattress.

The system components can be nonmetallic and, when properly installed, provide a vegetated earth-reinforced slope or surface that can be installed by anyone with basic construction know-how and skill. Suitable examples of nonmetallic materials include, but are not limited to, nylon, polyethylenes (e.g., high density polyethylene (HDPE)), polypropylene, polyesters, polyphenylene oxide, certain fluoropolymers, and mixtures thereof.

In some embodiments, more than one mattress may be used at a location. If additional mattresses are needed, additional mattresses (or partial mattresses) may be constructed and placed to overlap in the direction of flow.

Figure 11:
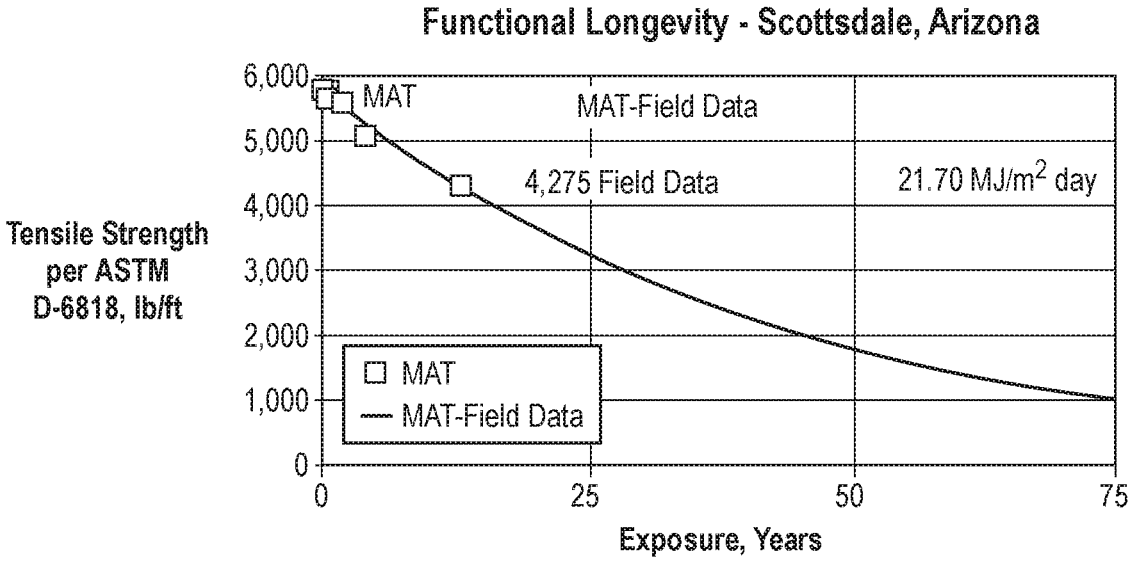
FIG. 11 is a graph showing the longevity of an exemplary geosynthetic material.

In a particular embodiment, the geosynthetic material is a geotextile fabric. A series of performance tests were done to demonstrate efficacy of certain exemplary geotextile mats in accordance with embodiments described herein. Sample A is a pyramidal nonwoven mat having round monofilament fibers. Sample B is a pyramidal woven mat having trilobal monofilament fibers. The control is uncovered soil having no mat. Tests results are shown in the following Tables. Tensile strength is reported in Table 1. Germination testing is reported in Table 2 and Bench-Scale shear testing in Table 3. Shear stress is reported in Table 4. UV resistance is measured according to ASTM D-4355 and is reported in Table 5. Functional Longevity is shown in FIG. 11.

Tensile strength is measured according to ASTM D 6818 and resiliency testing is conducted according to ASTM D 6524, as reported in Table 1.

TABLE 1

Comparative Evaluation of Pyramidal Fibers

| Property | Me | Units | Current Specification MARV[a] | Sample A | Sample B | % difference of Std. Data |
|---|---|---|---|---|---|---|
| Thickness | MD | mils | 500 | 409 | 393 | −4% |
| Mass per unit area | MD | Oz/yd$^2$ | 14 | 15.11 | 13.69 | −9% |
| Resiliency | MD | % change | −20 | −7.1 | −11.3 | 50% |
| Flexibility | MD | mg-cm | N/A | 726532 | 610969 | −16% |
| Tensile Strength - MD | MD | lb/ft | 3200 | 4752 | 4560 | −4% |
| Tensile Strength - XMD | | lb/ft | 2200 | 3192 | 3468 | 9% |
| Tensile Elongation - MD | MD | % | 65 (MAX) | 42 | 50.7 | 21% |
| Tensile Elongation - XMD | | % | 65 (MAX) | 38.7 | 36 | −7% |
| Light Penetration | MD | % | 25 | 13.5 | 6.6 | −51% |
| Ground Cover | | % | 75 | 86.5 | 93.4 | 8% |

[a]minimum average roll value

As can be seen in Table 1, the geotextile mat made from the trilobal fibers (Sample B) has more favorable attributes than the geotextile mat made from round fibers and is thus better suited for use in soil erosion prevention structures. For example, the resiliency of Sample B is higher than that of Sample A and shows that Sample B performs better at resisting short-term, repeated compression loadings. This means that the newly vegetated seeds would be better protected from damage during loading in Sample B—the trilobal mat.

Another important feature is the increased flexibility of Sample B over Sample A. The lower value for flexibility in the Table 1 indicates a more flexible product, which has an increased ability to conform to the surface upon which it is placed, thereby having more intimate contact. Sample B, the trilobal mat, has better flexibility.

In addition, for Sample B the tensile strength is higher than that of Sample A. The increased tensile strength provides more resistance to stresses on the mat. The tensile elongation of Sample B is also higher than Sample A.

Table 1 likewise shows that the light penetration is less for Sample B (a lower value indicates a denser configuration) than Sample A. Light penetration is a function of the percent open area of a mat, with denser mats better able to trap and contain fine particles. This is especially critical when vegetation is absent or newly established and where root mass provides little or no contribution to the containment. Thus, the testing of Table 1 shows the trilobal mat is more durable and better able to support plant growth.

The second test measures the amount of vegetative growth on the geotextile mat. The test procedure followed is that developed by the Erosion Control Technology Council (ECTC) designated as the "Standard Index Test Method for Determination of Temporary Degradable Rolled Erosion Control Product Performance in Encouraging Seed Germination and Plant Growth."

TABLE 2

Germination Testing

| Property | Units | Day | Control | Fabric A | Fabric B | % difference to Std Data |
|---|---|---|---|---|---|---|
| Seeds Germinated | # per 4 in$^2$ | 0 | 0 | 0 | 0 | n/a |
| | | 7 | 0 | 0 | 0 | n/a |
| | | 14 | 2.6 | 0 | 4.4 | n/a |
| | | 21 | 8.2 | 0.8 | 12.7 | 1488% |
| Average Plant Height | inch | 0 | 0 | 0 | 0 | n/a |
| | | 7 | 0 | 0 | 0 | n/a |
| | | 14 | 1.4 | 0 | 1.4 | n/a |
| | | 21 | 1.6 | 1 | 1.5 | 50% |
| Plant mass | mg per 4 in$^2$ | 21 | 3.9 | 1 | 8.6 | 760% |

The data shows that after 21 days, Sample B (geotextile with a trilobal monofilament yarn) had a 1488% improvement in seed germination per unit area as compared to Sample A, a similar mat made with round monofilament yarn. This result is unexpected and surprising given the only major difference between the Samples is yarn shape. Likewise, the average plant height was surprisingly improved for Sample B.

In addition, the plant mass area was surprisingly improved, with Sample B showing 760% improvement over Sample A. Thus, the geotextile mat having trilobal yarns is shown better for seed germination and plant growth as compared to the geotextile mat having round yarns.

The third test is shear testing. Bench-Scale shear testing employs the following apparatus and procedures. First, pots containing soil are immersed in water and the surface was subjected to shear stresses caused by the rotation of an impeller for 30 minutes. The pots have an 8 inch diameter and a 4 inch depth. The impeller is mounted so that the blades are slightly above the surface of the pots. The internal table has openings that hold the pots. When the pots are placed in the table opening, the test surface is flush with the table top. The amount of soil that eroded was found by weighing the containers of saturated soil both before and after testing. Test are run at three shear stress levels. From this data, the shear stress associated with a critical amount of soil loss is calculated. Shear ($X=lb/ft^2$) is calculated using the formula x=y*ŷ*2f where unit weight of water ($lb/ft^3$)=y; flow depth (f)=ŷ; and angle of energy grade line (degrees) =2f.

TABLE 3

Bench-Scale Shear Testing

| psf | Sample A | Sample B | % difference to Std Data |
|---|---|---|---|
| 3.87 | 413 | 288 | −30% |
| 4.72 | 590 | 370 | −37% |
| 5.57 | 683 | 432 | −37% |

With reference to Table 4, it is seen that shear stress and velocity are improved for Sample B. Additionally, growing times decreased by at least 50% for Sample B as compared to Sample A.

The tensile strength and UV resistance of the geotextile mat used in Sample B is shown in Table 5. The mat is subjected to physical and mechanical property testing as well as UV resistance testing for exposures of 500 hours, 1000 hours, 3000 hours and 6000 hours according to the ASTM methods listed in Table 5.

TABLE 4

Pyramidal Fabric Tested with Standard Kentucky Bluegrass Vegetation

| | Unit of Measure | Traditional Round | Multi-Lobe | Performance Improvement |
|---|---|---|---|---|
| Shear Stress | $LB/ft^2$ | 10.1 | 13.3 | 32% |
| Velocity | Ft./sec. | 15 | 17.9 | 19% |
| | Unit of Measure | Traditional Round | Multi-Lobe | Decrease Growing Time |
| Planted | Months | June 1999 | June 2004 | −71% |
| Tested | | June 2000 | Mid-September 2004 | |
| Duration | | 12 | 3.5 | |

TABLE 5

Independent Test Results vs. Published Test Results

| Property | Units | Test Method | Test Average | Published Value[1] |
|---|---|---|---|---|
| Tensile Strength - MD | lb/ft | ASTM D-6818 | 5,750 | 4,000 |
| Tensile Strength - TD | lb/ft | ASTM D-6818 | 3,708 | 3,000 |
| Elongation - MD | % | ASTM D-6818 | 56 | 40 |
| Elongation - TD | % | ASTM D-6818 | 41 | 35 |

TABLE 5-continued

Independent Test Results vs. Published Test Results

| Property | Units | Test Method | Test Average | Published Value[1] |
|---|---|---|---|---|
| Thickness | in | ASTM D-6525 | 0.61 | 0.40 |
| Resiliency | % | ASTM D-6524 | 87 | 80 |
| Mass/Unit Area | $oz/yd^2$ | ASTM D-6566 | 13.9 | 13.5 |
| Light Penetration | % | ASTM D-6567 | 8 | 10 |
| Flexural Rigidity | mg-cm | ASTM D-6575 | 1,192,189 | 616,154 |
| UV Resistance at 500 Hours | % | ASTM D-4355 | 98% | — |
| UV Resistance at 1,000 Hours | % | ASTM D-4355 | 99% | — |
| UV Resistance at 3,000 Hours | % | ASTM D-4355 | 96% | — |
| UV Resistance at 6,000 Hours | % | ASTM D-4355 | 90%[2] | 90% |
| UV Resistance at 10,000 Hours | % | ASTM D-4355 | — | 85% |

[1]All values have been obtained from published literature.

[2]While current third-party testing shows a result of 87%, an average of third party and internal GAI-LAP Accredited Testing shows a result of 90%.

The results demonstrate that Sample B has 90% UV resistance at 6,000 hours, which is very stable and increases the durability of the mat. Many government agencies require a UV resistance of 80% at 3,000 hours.

In order to determine the functional longevity of Sample B, the UV stability can be correlated with field performance. After the tensile strength of the mat is measured, a correlation can be made in order to establish an acceleration factor which serves to adjust lab test results for UV stability with actual conditions in use.

Samples of the geotextile mat of Sample B were taken from the Bell Road Channel in Scottsdale, Ariz., where local solar radiation is 21.70 $MJ/m^2$ per day, to determine the retained tensile strength of the mat after 13 years of exposure. The data shown in FIG. 11 indicates an average retained tensile strength of 4275 lb/ft and an acceleration facture of 4.9. The longevity of the geotextile mat of Sample B is illustrated in FIG. 11. This test again indicates that the geotextile mat of Sample B is very durable and has a long life span.

Vegetation is another form of erosion control. The combination of the vegetation's average root length and average root volume established in the soil below a geotextile mat has an impact on hydraulic performance. Testing is performed according to ASTM D6460 procedures. Table 6 shows the full-scale test results for two types of woven geotextile mats, one having 25 year UV stability and the other having 75 year UV stability—both made with trilobal fibers and being pyramidal. The results show that when the mats are increasingly vegetated, there is more shear stress and the amount of soil erosion is also lessened.

TABLE 6

| Product | Vegetation Condition | Soil Type | Soil Loss | Shear Stress psf (Pa) |
|---|---|---|---|---|
| Trilobal Mat 25 yr. UV Resistance | 90% Vegetated | Loam | <0.5 | 12.00 (574.16) |
| Trilobal Mat 75 yr. UV Resistance | 30% Vegetated | Loam | <0.5 | 8.00 (382.78) |
| | 70% Vegetated | Loam | <0.5 | 12.00 (574.16) |
| | 90% Vegetated | Loam | <0.5 | 16.00 (765.55) |

Another test completed includes Wave Topping, which simulates the hydraulic forces seen when a levee or berm is overtopped by waves or storm surge. The Wave Topping Test examines wave overtopping resiliency of Bermuda sod reinforced with a trilobal fiber, pyramidal woven geotextile mat, such as Sample B. The Bermuda sod is in excellent condition prior to testing. The test consists of intermittent overflow of water that is characterized as highly turbulent, super-critical, and unsteady in both time and down-slope distance. Peak flow velocities of such a test can be several times greater than the velocities of steady overflow having the same average discharge. Full-scale levees are simulated by planter boxes or trays that are especially prepared to mimic the geometry and vegetated surfaces of typical levees. The trays contain clay soil, the geotextile mat on top of that, and overlying that the Bermuda sod. The tested geometry is constructed using two steel trays where the upper portion of the levee slope is represented by a straight tray having a length of 20 feet. The tray for the lower portion of the levee has a bend with 8 feet of the length oriented on a 3H:1V slope and 12 feet oriented on a 25H:1V slope. Both planter trays making up a "set" have a width of 6 feet and depth of 12 inches. The test consists of discharging water from the reservoir at a rate of 2.0 $ft^3/s$ per ft. (cfs/ft.) for the first hour, 3.0 cfs/ft. for the second hour, and 4.0 cfs/ft for the third hour. During the successive tests, the stability of the trays is monitored, and their soil loss is measured. The effectiveness of the mat is determined by the material's ability to retain the underlying soil throughout the testing simulation.

The overlapping test simulated incident wave conditions having a significant wave height of 8.0 feet with a peak spectral wave period of 9 s. Three identical tests were run in a wave overtopping simulator and each segment was equivalent to 1 hour of overtopping in nature with an average overtopping discharge of 4.0 cfs/ft.

Generally, the Bermuda grass reinforced with the trilobal fiber, pyramidal woven geotextile mat performed well. Above the mat, the material around the grass crowns was eroded away by the swift water flows and at a few locations the mat was exposed when the overlying material was removed. Soil loss beneath the mat did not occur over most of the tested slope. At the one location where the mat was exposed, the total loss included the cover layer over the mat (between 0.75 and 1.25 inches) and less than 1 inch of soil loss beneath the mat. Furthermore, the soil loss beneath the mat was confined to a relatively small area at the transition between the slopes. The overall integrity of the geotextile mat system was judged to be very good for the extreme hydraulic load testing conditions.

It is specifically intended that the present disclosure not be limited to the embodiments and illustrations contained herein, but include modified forms of those embodiments including portions of the embodiments and combinations of elements of different embodiments as come within the scope of the following claims.

The invention claimed is:

1. A method of constructing an internally braced synthetic mattress comprising the steps of:

(a) laying out a first portion of a geosynthetic material, (b) folding at least a portion of the first portion of geosynthetic material at a fold line to form an upright side, thereby forming a geosynthetic material structure having a bottom side and the upright side, (c) installing at least one angle brace, wherein the installing comprising weaving at least one horizontal bar into the first portion of the geosynthetic material, connected a first end of an upright bar to a first end of the at least one horizontal bar, and connecting a diagonal bar to each of the horizontal bar and upright bar such that each end of the diagonal bar connects with a respective second end of the horizontal bar and upright bar, (d) filling the geosynthetic material structure with a filler, and (e) securing a second portion of a geosynthetic material having a size and shape approximately equal to that of the bottom side over the filler and to the upright side of the geosynthetic material structure to form the mattress.

2. The method of claim 1, wherein the at least one angle brace is installed adjacent to at least one edge of the geosynthetic material and the at least one horizontal bar is inserted into a weave of the geosynthetic material so that the first end of the horizontal bar aligns with the fold line of the geosynthetic material.

3. The method of claim 2, wherein the step of installing the at least one angle brace includes weaving the upright bar into the geosynthetic material of the upright wall.

4. The method of claim 1, further including the step of placing vegetation over the mattress.

5. The method of claim 1, further comprising installing at least one baffle prior to filling the geosynthetic material structure with a filler.

6. The method of claim 5, wherein the step of installing at least one baffle comprising:

providing a second portion of a geosynthetic material having a fold line;

installing, at uniform spacing along the second portion of the geosynthetic material, a plurality of upright bars by inserting each upright bar into a weave of the of the second portion of the geosynthetic material so that a first end of the horizontal bars aligns with the fold line of the second portion of the geosynthetic material;

installing, at locations adjacent the horizontal bars, a plurality of upright bars by inserting each upright bar into a weave of the second portion of the geosynthetic material so that a first end of the upright bars is adjacent the first end of a respective horizontal bar to form horizontal bar/upright bar pairs;

folding the second portion of the geosynthetic material at the fold line;

connecting the first ends of the respective horizontal bar/upright bar pairs;

connecting a diagonal bar to each horizontal bar/upright bar pair such that each end of the diagonal bar connects with a second end of the horizontal and upright bars of a horizontal/upright bar pair to form the completed baffle; and securing the completed baffle to the first portion of geosynthetic material.

7. The method of claim 5, wherein the at least one baffle extends away from the upright wall.

8. The method of claim 5, wherein the step of securing a second portion of a geosynthetic material having a size and shape approximately equal to that of the bottom side over the filler and to the upright side of the geosynthetic material structure to form the mattress further includes securing the second portion of a geosynthetic material to the at least one baffle.

9. The method of claim 1, wherein the geosynthetic material is a geosynthetic fabric designed to retain a material having an average diameter of less than 10 inches.

10. The method of claim 1, further comprising repeating steps (b) and (c) to form a second upright side opposed to the upright side.

11. The method of claim 10, further comprising installing at least one baffle.

12. The method of claim 11, wherein the at least one baffle extends between the upright sides.

13. The method of claim 11, wherein the step of securing a second portion of a geosynthetic material having a size and shape approximately equal to that of the bottom side over the filler and to the upright side of the geosynthetic material structure to form the mattress further includes securing the second portion of a geosynthetic material to the at least one baffle.

14. The method of claim 1, wherein the geosynthetic material is a three-dimensional, cuspated profile, woven mat comprising a trilobal thermoplastic filament yarn.

15. The method of claim 1 wherein the step of laying out a first portion of a geosynthetic material comprises laying out the first portion of the geosynthetic material in a location to control erosion.

* * * * *